US005213052A

United States Patent [19]

Wilke

[11] Patent Number: 5,213,052

[45] Date of Patent: May 25, 1993

[54] SEWING MACHINE WITH AN ADJUSTING DEVICE

[75] Inventor: Hans Wilke, Wartenberg-Rohrbach, Fed. Rep. of Germany

[73] Assignee: G. M. Pfaff Aktiengesellschaft, Kaiserslautern, Fed. Rep. of Germany

[21] Appl. No.: 892,215

[22] Filed: Jun. 2, 1992

[30] Foreign Application Priority Data

Jun. 3, 1991 [DE] Fed. Rep. of Germany ..... 4118119

[51] Int. Cl.[5] ..... D05B 19/00; D05B 37/04

[52] U.S. Cl. ..... 112/121.11; 112/130; 112/272; 112/275; 112/277

[58] Field of Search ..... 112/121.11, 130, 152, 112/121.27, 305, 277, 272, 271, 147, 136, 275, 274, 314

[56] References Cited

U.S. PATENT DOCUMENTS

| | | | |
|---|---|---|---|
| 3,329,113 | 7/1967 | Lewis . | |
| 4,112,860 | 9/1978 | Ellington et al. | 112/147 X |
| 4,276,837 | 7/1981 | Biermann | 112/152 |
| 4,569,297 | 2/1986 | Düsch | 112/221 |
| 4,895,088 | 1/1990 | Pirrello et al. | 112/130 |
| 5,146,860 | 9/1992 | Niwa et al. | 112/130 X |

*Primary Examiner*—Clifford D. Crowder
*Assistant Examiner*—Paul C. Lewis
*Attorney, Agent, or Firm*—McGlew & Tuttle

[57] ABSTRACT

A sewing machine is provided with an adjusting device for hem projection length sensors that can be moved relative to a cutting device, wherein the first hem projection length sensor is provided for sending a signal that brings about a cutting process for the front hem projection length, and the second of the sensors is provided for sending a signal that brings about a cutting process for the rear hem projection length. The length of the respective hem projection length and the width of an associated seamless fabric edge shall be able to be set depending on each other with minimum operator effort by the adjusting device both at the beginning and the end of the fabric. The adjusting device has a stop that is movable in the direction of feed for the front edge of the fabric for presetting the width of a seamless front fabric edge. The distance from the stitch formation site can be used to preset the position of the hem projection length sensor, and which serves to dimension a seamless rear fabric edge adjoining the end of the seam. A residual seam length is determined from the difference between the fabric end length and the width of the seamless front edge of the fabric. A control is provided for stopping the needle bar in its top reversal position when this residual seam length is reached. A measuring device for measuring the feed distances of the fabric can be activated by a signal of a sensor which is arranged in front of the stitch formation site and indicates the fact that the actual fabric end length drops below a predeterminable fabric end length.

6 Claims, 4 Drawing Sheets 105
118
116
106
126
110
111
112
113
114
115
117
123
124
125
8
6
7
9
10
12
13
96
100
101
102
103
104
38
39
40
41
42
43
48
107
108
1
34
46
53
119
120
121
122
26
27
31
35
22
23
OE1
OE2
OE3
OE4
OE5
OE6
OE7
OA1
OA2
OA3
OA4
OA5
OA6
OA7
A1
A2
A3
A4
A5
A6
A7
E1
E2
EZ
AZ
EE
AE
ER
AR
IE1
IE2
IE3
IE4
IE5
A

SEWING MACHINE WITH AN ADJUSTING DEVICE

FIELD OF THE INVENTION

The present invention pertains to a sewing machine with an adjusting device for adjusting hem projection length sensors that can be moved relative to a cutting device including a first sensor provided for sending a signal to initiate a cutting process for a front hem projection length and a second sensor of which is provided for sending a signal for bringing about a cutting process for a rear hem projection length.

BACKGROUND OF THE INVENTION

U.S. Pat. No. 3,329,113 discloses a device with a cutting device and with sensors, whose distance from the cutting device is variable. The cutting device is activated by a signal of the sensor that is the front sensor in the direction of feed for a first cutting process. The first cutting process cuts through a connection means for a plurality of fabric parts, at a distance from the front edge of the respective fabric. This distance depends on the distance between this sensor and the cutting device. The cutting device is activated by a signal of the rear sensor for another cutting process, by which the connection means is cut through at a distance from the rear edge of the fabric, which distance depends on the distance between this sensor and the cutting device.

On a fabric that has hem projection lengths relative to its front and rear edges, the hem projection lengths can be shortened to a predeterminable length by this device. If the hem projection lengths are to be folded over at the respective fabric edge and they are to be pushed into the associated part of the hem, at least this part of the hem must not have a seam connection with the rest of the fabric part. However, the above mentioned U.S. Pat. No. 3,329,113 does not indicate how the seam formation could be limited to the middle part of the hem.

A device with a stitch counter is described in U.S. Pat. No. 4,276,837; this stitch counter is switched on as soon as the distance between the rear edge of the fabric and the stitch formation site, which distance is indicated by a sensor, drops below a predetermined value, and it remains in operation until it reaches a predeterminable end value. A feed distance for the fabric, which is obtained from the predetermined distance from the stitch formation site minus the width of a seamless rear fabric edge, is associated with this end value. Seam formation is terminated when the end value is reached.

Although the width of the seamless rear fabric edge can be preselected by this device by presetting the end value, it is necessary to reset the stitch counter if the fabric has hem projection lengths, and the width of the seamless rear fabric edge is to be adjusted to the rear hem projection length each time the length of this hem projection length changes. Since the above mentioned U.S. Pat. No. 4,276,837 contains no data on this, it can be assumed that the resetting must be performed by the operator.

Contrary to the seamless rear fabric edge, the formation of a similar front fabric edge is not possible with this device.

SUMMARY AND OBJECTS OF THE INVENTION

It is a primary object of the present invention to provide an adjusting device by which the length of the respective hem projection length and the width of an associated seamless fabric edge can be adjusted depending on one another, with a minimum of operator effort, for processing a fabric provided with hem projection lengths both at its beginning and at its end.

According to the invention, a sewing machine is provided including a first sensor provided for sending a signal for initiating a cutting process for a front hem projection length and a second sensor for sending a signal for initiating a cutting process for a rear hem projection length and adjusting means for adjusting the position of the first sensor and second sensor relative to a cutting device. A stop is provided including means for moving the stop in a feed direction for positioning a front edge of the fabric to be sewn for presetting a width of a seamless front edge of the fabric being sewn. A distance of the stop from a stitch formation site is used for predetermining a position of the hem projection length sensors. A position of the stop is used to dimension a seamless rear edge of fabric being sewn, which edge joins an end of the seam in such a way that a residual seam length, formed from a difference between the fabric end length and the width of the seamless front fabric edge, can be preset by said adjusting means for stopping a needle bar in a top reversal position when said residual seam length is reached. A measuring device is provided for measuring feed distances of the fabric being sewn. A forward sensor, located in front of the stitch formation site, is provided for activating the measuring device. The forward sensor provides an indication of the fact that the actual fabric end length has dropped below a predeterminable fabric end length.

If the fabric is to have a seamless front edge between its front edge and the beginning of the seam to be formed, the stop is positioned at a distance from the stitch formation site that corresponds to the desired width of the fabric edge, behind the stitch formation site in the direction of feed. Therefore, when the front edge of the fabric is placed against the stop, the site of the fabric at which the first stitch of the seam to be formed is made will be located beneath the needle.

Since the distance between the hem projection length sensors and the cutting device is set depending on the position of the stop in relation to the stitch formation site, it is ensured that the length of the hem projection length at the front edge of the fabric, hereinafter called front hem projection length for short, is always adjusted to the width of the seamless front edge of the fabric, on the one hand, and, on the other hand, there is a constant length ratio between the front hem projection length and that at the rear edge of the fabric (rear hem projection length), and the same length is preferably selected for both hem projection lengths.

To obtain the same ratio between the length of the hem projection length and the width of the seamless fabric edge at the rear edge of the fabric as at the front edge of the fabric, the constant fabric end length, which is consequently known prior to the beginning of a sewing process, is reduced by a distance, whose amount depends on the distance between the stop and the stitch formation site, by utilizing the length ratio of the two hem projection lengths.

Consequently, a plurality of adjustment processes are performed by the adjusting device automatically by only one presetting being performed by the operator, namely, by, presetting the position of the stop. As a result, a hem can be sewn onto a fabric such that the respective hem projection length can be pushed over its entire length into the associated part of the hem when the front hem projection length is folded over at the front edge of the fabric and the rear hem projection length is folded over at the rear edge of the fabric.

If the distance between the two hem projection length sensors is selected to be such that it corresponds to the length of the two hem projection lengths, the width of the seamless front fabric edge that is needed to form the residual seam length can be determined by the measuring device based on a measuring process initiated by a signal from the first hem projection length sensor (which determines the dimension of the seamless front fabric edge) and the measuring process can be concluded by a signal sent by the second hem projection length sensor. It is now possible to dispense with a device by which a value associated with the position of the stop can be preset for the measuring device.

The measuring device may include a counting device for stitch formation cycles performed during the measuring process. The feed distance passed over by the fabric being sewn corresponds to the product of the count value of the counting device and the stitch length. Such a stitch length may be preselectable on a stitch length mechanism. This arrangement provides a variant of the adjusting device, with which a particularly accurate dimensioning of the residual seam length is possible.

Unlike in the case of the seamless front fabric edge, which can be predetermined via the stop with high accuracy, the width of the seamless rear fabric edge depends on the sewing conditions, e.g., the stitch formation frequency. If a particularly accurate dimensioning of the width of the latter fabric edge is desired, the sewing conditions must be taken into account. This can be done by associating a memory for correction values with the adjusting device.

A variant of the adjusting device according to the present invention may be provided wherein the hem projection length sensors can be moved by a drive mechanism. The drive mechanism is controlled in terms of direction and amount as a function of a preset position of the stop, while maintaining a constant distance ratio from the cutting device, in relation to the cutting device. This arrangement is advantageous if the length ratio between the front and rear hem projection lengths is to be independent of the absolute length of the front hem projection length.

The cutting device is preferably arranged centrally between forward hem projection length sensor and the rear hem projection length sensor. The hem projection length sensors are moved by the drive mechanism by equal distances and in opposite directions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 4:
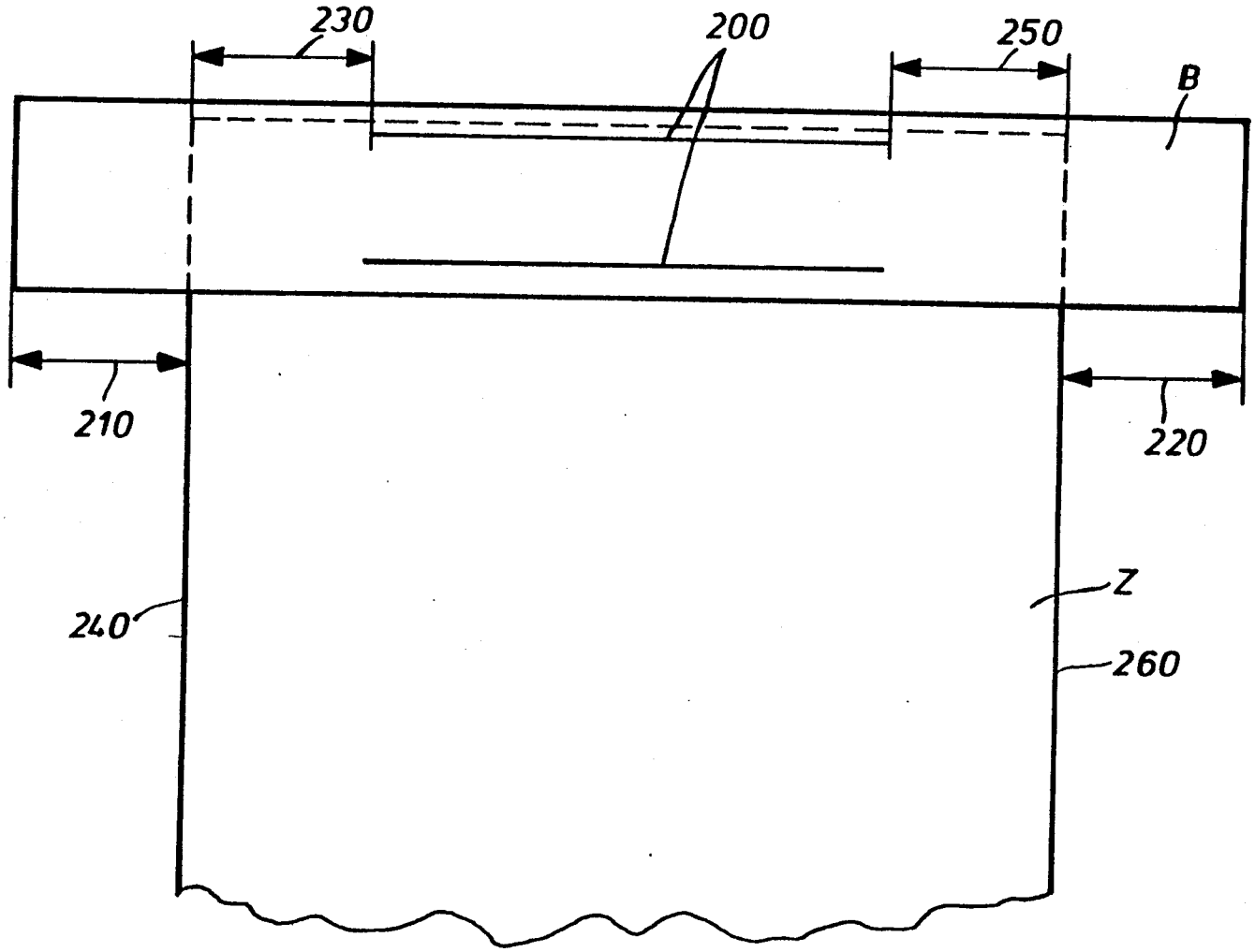
FIG. 4 is a schematic view showing a hem connected to a fabric according to the invention.

Referring to the drawings and in particular FIG. 4, the invention is provided for connecting a fabric part or cut part workpiece Z to a hem B. In the connected state, the hem B is folded in its middle and is connected to the fabric Z along a seam 200. The invention provides a sewing machine for accurately providing a front hem projection length 210 by a cutting process and by also providing a rear hem projection length 220 by a further cutting process. A seamless front edge 230 is preferably provided (for example such that the hem projection length may be folded over at a front fabric edge 240 and such that the projection length 210 may be pushed into the associated part of the hem). A seamless rear edge 250 may also be provided (the distance from the end of the seam 200 to the rear fabric edge 260).

Figure 1:
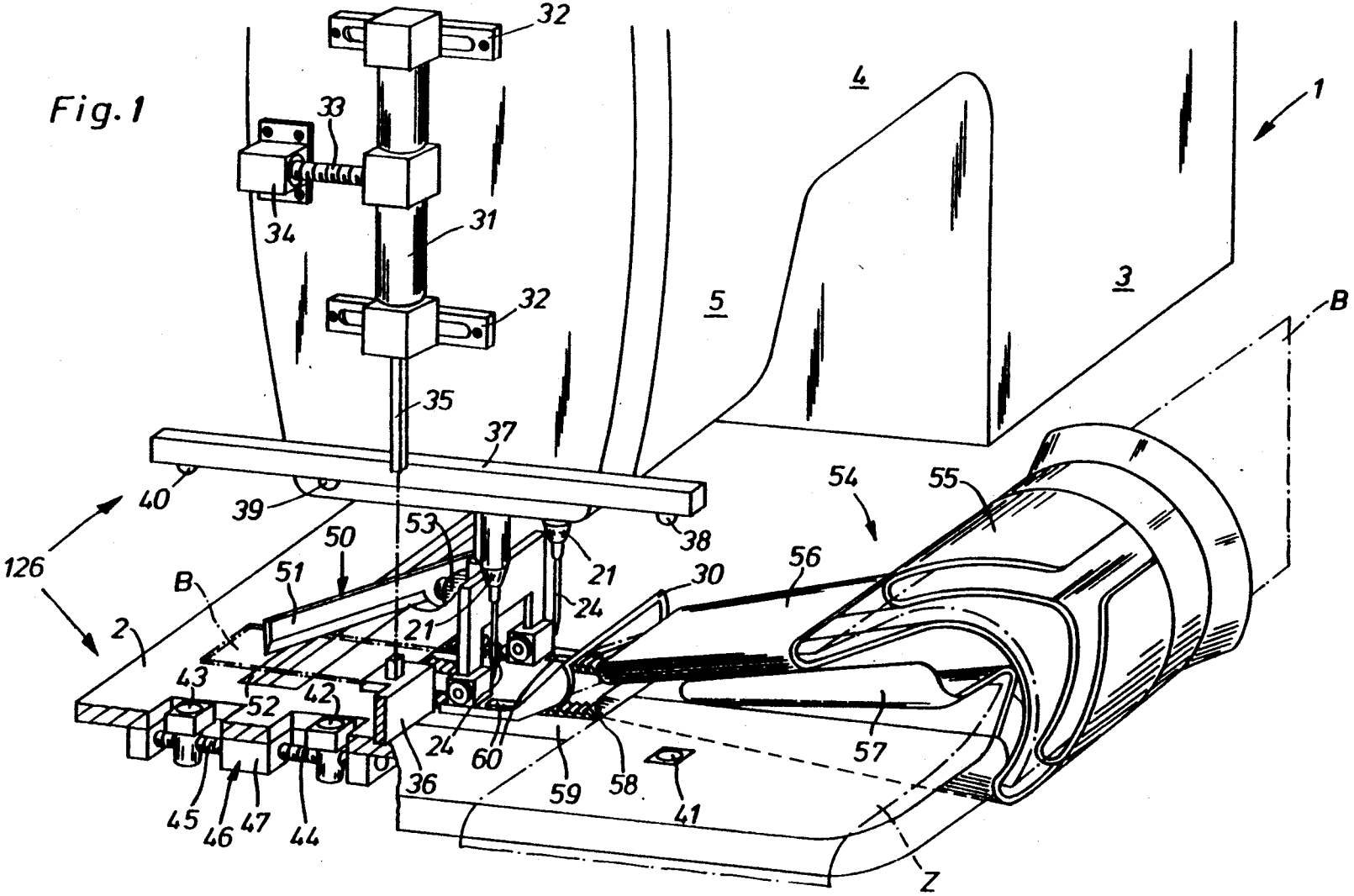
FIG. 1 is a perspective view of a sewing machine for feeding a hem and for sewing it to a cut part.

FIG. 1 shows a sewing machine whose housing 1 is formed by a base plate 2, a stand 3, an arm 4, and a head 5. A main shaft 6 (FIG. 2), which carries a pulse disk 7 of a pulse generator 8, is mounted in the arm 4. An opening 9, toward which a photodiode 10 of the pulse generator 8 is directed, is provided on the pulse disk 7. After passage through the opening 9, the light beams reach a photodetector 12. The photodiode 10, as well as the photodetector 12, designed as a phototransistor (FIG. 3), are connected to the positive pole of a stabilized power source and grounded via a resistor 13 each.

Figure 2:
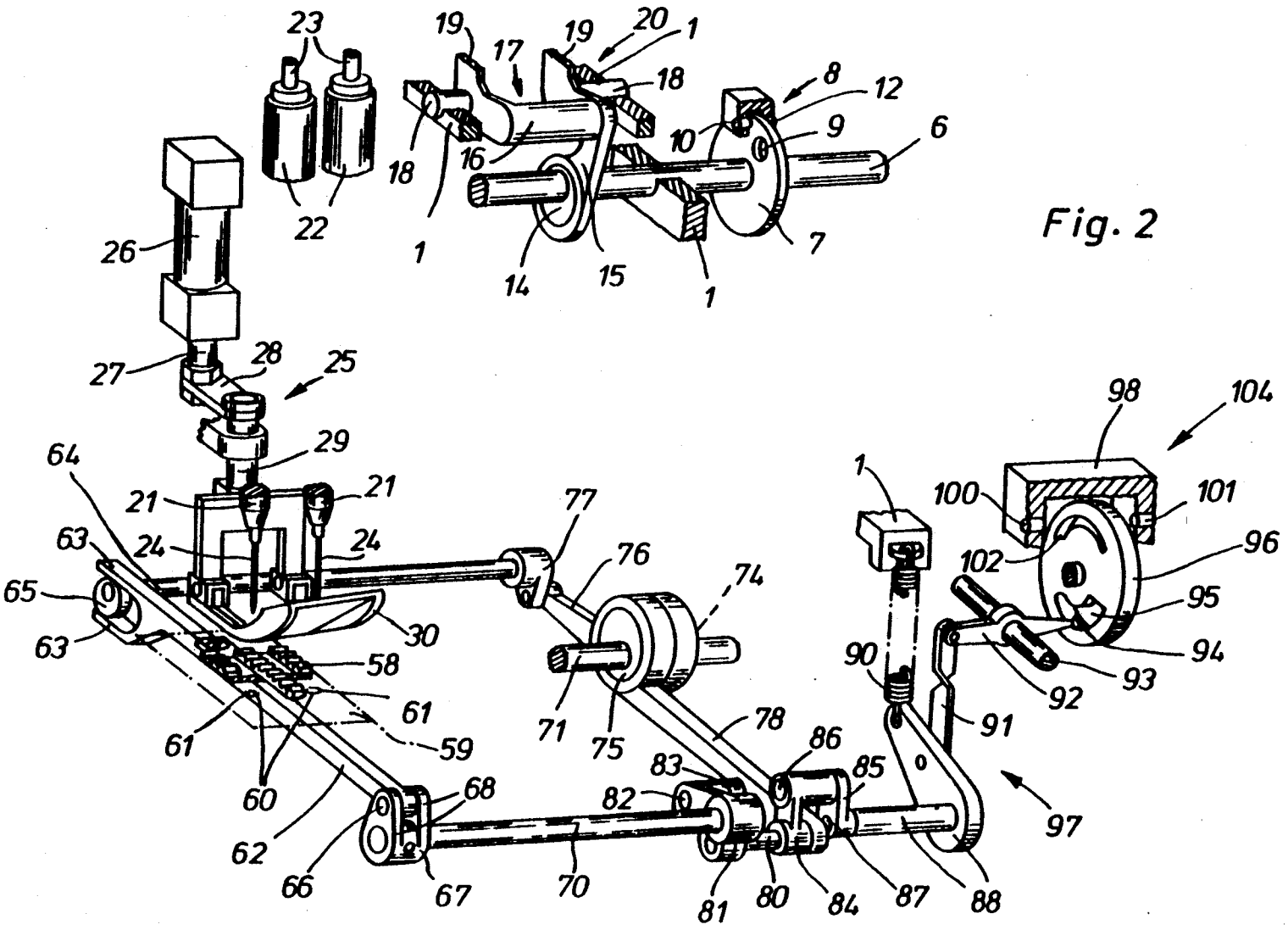
FIG. 2 is a schematic perspective view of a needle bar and stitch length mechanism drive of the sewing machine.

As is shown in FIG. 2, a cam 14, which is surrounded by a cam rod 15, is attached to the main shaft 6. The free end of the cam rod 15 is hinged to the web part 16 of a fork-shaped, two-armed lever 17, which is pivotably mounted in the housing 1 by means of a pivot pin 18, and has driven arms 19. The lever 17 forms part of a switching device 20 known from U.S. Pat. No. 4,569,297, which provides the possibility of switching off the needle bars 21 of the sewing machine in their top reversal position by single-acting cylinders 22, actuated by a pressure medium, whose piston rods 23 are connected to the switching device 20, being activated to withdraw their piston rods 23. Due to the release of the pressure in the cylinders 22, the piston rods 23 will again return into their starting position under the effect of a compression spring each arranged in the cylinder 22. The needle bars 21, each of which carries a needle 24, are now again switched on. The top reversal position of the needle bars 21 is now indicated via the pulse generator 8, because the opening 9 in the pulse disk 7 will then be located in the path of light between the photodiode 10 and the photodetector 12.

A presser foot device 25 is arranged in the head 5 of the sewing machine. This presser foot device 25 has a single-acting, pressure medium-actuated cylinder 26, whose piston rod 27 is connected to the presser bar 29, to which the presser foot 30 is attached, via a connection element 28.

As is shown in FIG. 1, another, single-acting, pressure medium-actuated cylinder 31, which is mounted displaceably in horizontally extending guide rails 32 and is connected via a spindle 33 to an actuating drive 34 formed by a stepping motor, is provided on the front side of the head of the sewing machine. A stop 36 for the fabric to be sewn, which stop can be lowered onto the base plate 2, is attached to the piston rod 35 of the cylinder 31. In addition, a strip 37, which carries a photodiode 38 in front of the needles 24 in the direction of feed and photodiodes 39 and 40 arranged at different distances from the needles 24, behind the needles 24, is also arranged on the front side of the head.

A sensor 41, which is aligned with the photodiode 38, is stationarily arranged in the base plate 2, and two hem projection length sensors 42 and 43, of which the hem projection length sensor 42 is aligned with the photodiode 39, and of which the hem projection length sensor 43 is aligned with the photodiode 40, are arranged movably in the base plate 2. The hem projection length sensor 42 is arranged on a spindle 44, whose threads have the same pitch as the threads of a spindle 45 housing the hem projection length sensor 43, but is provided with threads extending in the opposite pitch direction. Both the spindles 44 and 45 are connected to a common drive mechanism 46 in the form of a stepping motor 47.

The photodiodes 38 through 40, as well as the sensors 41 through 43, designed as phototransistors (FIG. 3), are connected to the positive pole of a stabilized power source, and are grounded via a respective resistor 48.

The sewing machine has a cutting device 50 (FIG. 1) with a movable blade 51, which is accommodated, like a stationary blade 52, in the base plate 2. The movable blade 51 is connected to a drive 53.

The sewing machine is provided with a hem feed means 54. This has folding plates 55 and 56 for folding the hem B and a guide plate 57 for a cut part Z, to which the hem is to be sewn. To feed the fabric to be sewn, which is formed by the cut part and the hem, the sewing machine has a feed dog 58, which extends through slots of a needle plate 59 housed by the base plate 2. The needle plate 59 is provided with passage openings 61 (FIG. 2) for the needles 24 at the stitch formation site 60.

As is shown in FIG. 2, the feed dog 58 is arranged on a feed dog support 62, whose fork-shaped end 63 surrounds a cam 65 attached to a shaft 64, and the shaft 64 imparts one stroke movement per stitch formation cycle to the feed dog 58. The other end of the feed dog support 62 pivotably acts on a pin 66 of a rocker 67. The rocker 67 has a fork-shaped design with arms 68 and is nonrotatably arranged on a shaft 70, which imparts one feed movement per stitch formation cycle to the feed dog 58.

Two cams 74 and 75 are nonrotatably mounted on a stitch length mechanism drive shaft 71, which is driven in a ratio of 1:1 to the main shaft 6. A cam rod 76 surrounding the cam 74 is hinged at its opposite end to a rocker 77 attached to the shaft 64. A second cam rod 78 surrounding the cam 75 is hinged on a pin 80, on which a connecting rod 81, which is connected by means of a pin 82 to a crank 83 attached to the shaft 70, is mounted. Next to the cam rod 78, a connecting rod 84, which surrounds a pin 86 carried by a crank 85, acts on the pin 80. The effective length of the connecting rod 81 is equal to that of the connecting rod 84, so that the shaft 70 remains immobile despite the cam rod 78 moving if the pins 82 and 86 are aligned.

To change the movement of the cam rod 78 acting on the shaft 70, the crank 85 is clamped on an adjusting shaft 87. The adjusting shaft 87 carries a second crank 88, on the free end of which a tension spring 90 attached to the housing 1 acts, and which is connected via a tie rod 91 to one end of an oscillating lever 92, which is attached to a shaft 93 mounted in the housing 1. The free end of the oscillating lever 92 has a spherical projection 94, which is arranged rotatably between side walls of an adjusting groove 95 of an adjusting wheel 96 that is arranged rotatably on an axle that is integral with the housing. The elements 80 through 96 form a stitch length mechanism 97, and the stitch length is set in the known manner by rotating the adjusting wheel 96.

The rotation position of the adjusting wheel 96 is monitored by a sensor device 98, which has a photodiode 100 on one side of the adjusting wheel 96, and a photodetector 101 on the other side of the adjusting wheel 96. The adjusting wheel 96 is provided with an opening 102, which is located in the path of the light of the sensor device 98 and is much narrower in the rotation position of the adjusting wheel 96 that is associated with "zero" stitch length than would be necessary for the passage of the total amount of light beams emitted from the photodiode 100. The opening continuously becomes wider in the direction of rotation corresponding to the increase in stitch length, until it reaches a width sufficient for the passage of all the light beams emitted by the photodiode 100 in the rotation position of the adjusting wheel 96 that is associated with the maximum stitch length. As a result, the photodetector 101, which is designed as a phototransistor (FIG. 3) and is connected, just as the photodiode 100, to the positive pole of a stabilized power source, and is grounded, just as the latter, via a respective resistor 103, acts as a stitch length monitor 104, because a light intensity received by the photodetector 101 is associated with each rotation position of the adjusting wheel 96.

Figure 3:
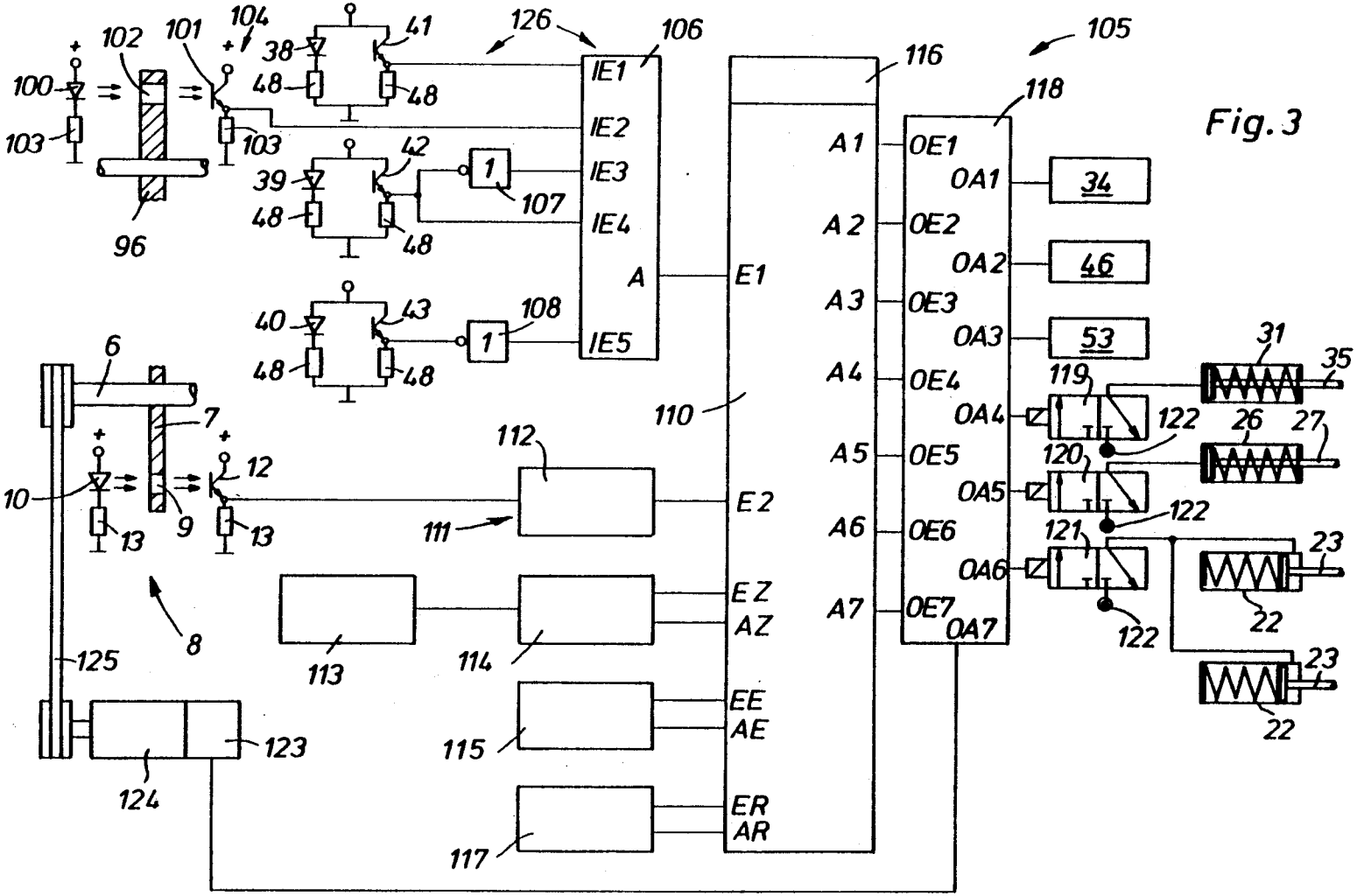
FIG. 3 is a schematic circuit diagram of a control device for the sewing machine.

As is shown in a simplified embodiment in FIG. 3, the sewing machine is provided with a control device 105. The control device 105 has an input device 106, which converts analog signals received at the inputs IE 1 through IE 5 into digital signals, and amplifies them. The sensor 41 is connected to the input IE 1 of the input device 106; the photodetector 101 of the stitch length monitor 104 is connected to the input IE 2; the hem projection length sensor 42 is connected to the input IE 3 via an inversion member 107; the hem projection length sensor 42 is connected directly to the input IE 4; and the hem projection length sensor 43 is connected to the input IE 5 via an inversion member 108.

The output A of the input device 106 is connected to an input E 1 of a control element 110, which may be formed by, e.g., a microprocessor. A measuring device 111, which has a counting device 112 that continuously adds up the pulses of the pulse generator 8, is connected to an input E 2 of the control element 110. A control panel 113 is connected to an input EZ as well as to an output AZ of the control element 110 via a buffer memory 114. An EPROM memory 115, in which a program for presetting the sequence of steps to be performed by the control element 110 is stored, is connected to an input EE as well as to an output AE of the control element 110. The steps are read from the EPROM memory 115 in a cadence predetermined by a timing generator 116 of the control element 110. A RAM memory 117 is connected to the input ER as well as to the output AR of the control element 110.

The control element 110 has further outputs A 1 through A 7, each of which is connected to a respective input OE 1 through OE 7 of an output device 118. The signals of the control element 110 are amplified by the output device 118.

The output device 118 is provided with outputs OA 1 through OA 7. The actuating drive 34 for displacing the cylinder 31 carrying the stop 36 is connected to the output OA 1; the drive mechanism 46 for the spindles 44 and 45 of the hem projection length sensors 42 and 43 is connected to the output OA 2; and the drive 53 of the cutting device 50 is connected to the output OA 3. One striker magnet each of an electromagnetically switchable directional control valve 119 through 121, hereinafter called E valve for short, which can be reset into its starting position by spring action, is connected to the outputs OA 4 through OA 6 of the output device 118. Of the E valves 119 through 121, all of which are connected to a compressed air source 122, the E valve 119 is connected to the cylinder 31 for the stop 36; the E valve 120 is connected to the cylinder 26 of the presser foot device 25; and the E valve 121 is connected to the cylinders 22 for switching off the needle bar. The control part 123 of a positioning motor 124 which drives the main shaft 6 via a V-belt drive 125 is connected to the output OA 7 of the output device 118.

An adjusting device 126 is formed by the elements 31 through 48 together with the control device 105.

The sewing machine operates as follows:

Prior to the beginning of a sewing process, the needle bars 21, the presser foot 30, the stop 36, and the movable blade 51 of the cutting device 50 are in the respective top reversal position. Before a fabric part Z is positioned by an operator, the operator sets the stitch formation frequency desired for the next sewing process on the control panel 113, and presets the edge width between the front edge 240 of the fabric Z and the beginning of the seam 200. These data are read into the input EZ of the control element 110 from the control panel 113 via the buffer memory 114 in the form of digitized signals.

The signal associated with the stitch formation frequency is sent from the output A7 of the control element 110 and is sent to the control part 123 of the positioning motor 124 via the output device 118. In contrast, the signal associated with the edge width causes the control element 110 to send one signal each from the outputs A1 and A2. The signal of the output Al is sent to the actuating drive 34 and presets for it the number as well as the direction of the drive steps to be performed. Based on its connection with the cylinder 31 via the spindle 33, the actuating drive 34 displaces the cylinder 31 in the direction of the guide rails 32 in relation to the stitch formation site during the performance of these drive steps. The distance between the stop 36 and the stitch formation site 60 is thus predetermined, as a result of which the width or dimension of a seamless front fabric edge 230, which extends from the front edge of the fabric 240 to the beginning of the seam 200, is determined.

The signal at the output A2 of the control element 110 causes drive steps to be predetermined for the drive mechanism 46 for driving the spindles 44 and 45, and the number and the direction of these drive steps are predetermined as a function of the distance of the stop 36 from the stitch formation site 60. It is thus achieved that the distance of each of the two sensors 42 and 43 from the cutting device 50 will always correspond to the distance of the stop 36 from the stitch formation site 60.

As soon as the adjustment process by the actuating drive 34 and the drive mechanism 46 is concluded, the control element 110 actuates the striker magnet of the E valve 119 by sending a continuous signal from its output A4, as a result of which this valve will be displaced to the right from its position shown in FIG. 3. This causes the piston rod 35 to extend from the cylinder 31. As a result, the stop 36 is lowered onto the base plate 2.

To position the cut part Z on the base plate 2, the cut part is placed with its front edge against the stop 36 and is pushed in the direction of the hem feed means 54 until it comes to lie against its the guide plate 57. In this position, the cut part Z covers the sensor 41, so that this sensor 41 will not receive any more light beams from the photodiode 38, and consequently it will not send any more signals to the input IE 1 of the input device 106.

After being introduced into the hem feed means 54, the hem B is folded in the middle as a consequence of its passage through the folding plates 55 and 56, so that its edges, which were in one plane before, will be opposite each other after the folding process. The hem B is fed by the hem feed means 54 to the cut part Z such that one of its hem halves will be arranged above the cut part Z and its other half will be located under this cut part Z.

After conclusion of the positioning process, the sewing process is started, e.g., by depressing a foot pedal, not shown, as a result of which a signal is sent to the control element 110 via a line, also not shown. The control element 110 now stops sending signals from its output A4, whereupon the E valve 119 returns into its starting position under spring action, thereby causing the cylinder 31 to lift the stop 36 off the base plate 2 by withdrawing the piston rod 35. A signal sent simultaneously from the output A5 of the control element 110 causes a continuous signal to be sent to the striker magnet of the E valve 120 for extending the piston rod 27 of the cylinder 26 to lower the presser foot 30 onto the fabric to be sewn. The positioning motor 124, which drives the main shaft 6 and, via this shaft, the needle bars 21, the stitch length mechanism drive shaft 71, which imparts its movement to the feed dog 58, as well as shuttle (or hook) drive shafts (not shown), is switched on by another signal sent from the output A7 of the control element 110. The shuttle drive shafts are driven in a ratio of 2:1 in relation to the other shafts.

As soon as the hem projection length sensor 42 is covered by the front edge of the fabric being sewn, the input device 106 receives a signal at its the input IE 3 because of the inversion member 107. After conversion and transmission to the input E1 of the control element 110, this signal causes the control element 110 to send a signal from the output A3. This signal is sent to the drive 53 of the cutting device 54, after which this performs a movement, by which the movable blade 51 is pivoted in the downward direction and cuts through the hem B. The fabric-side hem projection length 210 is now reduced to a length that corresponds to the distance between the hem projection length sensor 42 and the cutting device 50 and consequently to the width of the seamless front fabric edge 230, which is predetermined via the stop 36 at the beginning of sewing, so that the front hem projection length 210 can be pushed over its entire length into the associated part of the hem after conclusion of the sewing process. The movable blade 51 is subsequently pivoted back into its starting position by another signal being sent from the output A3 of the control element 110.

Simultaneously with the initiation of the cutting process, the control element 110 establishes at the input E2 the readiness for receiving the next count from the counting device 112. This count is stored in the RAM memory 117.

As soon as the fabric is fed to the extent that its front edge covers the hem projection length sensor 43, a signal is sent to the input IE 5 of the input device 106 because of the inversion member 108 succeeding the sensor 43. A signal subsequently sent to the control element 110 causes the control element 110 to receive a second count on the input E2, and, after the first count has been read from the RAM memory 117, to determine a hem projection length count associated with the distance between the two hem projection length sensors 42 and 43 and consequently with the length of the front and rear hem projection lengths 210, 220 by forming the difference of these counts. To determine this hem projection length count, only the difference between the two counts is needed, but their absolute value is not, so that it is not necessary to reset the counting device 112 to a predeterminable initial value before the first count is received. The hem projection length count is stored in the RAM memory 117.

When the sewing process has advanced so much that the rear edge of the fabric being sewn releases the sensor 41, the latter will receive light beams from the photodiode 38, and send a signal to the input IE 1 of the input device 106. This sends a signal to the input E1 of the control element 110, after which the control element reads at the input E2 the next count of the counting device 112, and polls the stitch length at the input E1. The stitch length is obtained by the photodetector 101 of the stitch length monitor 104 sending an electric signal, whose intensity corresponds to the intensity of the light beams received, to the input IE 2 of the input device 106, which latter will then send a digital signal associated with the signal intensity to the control element 110.

The distance between the sensor 41 and the stitch formation site 60, which will hereinafter be called fabric end length, is constant, and its value is stored in the RAM memory 117. After polling the fabric end length from the RAM memory 117, the number of stitch formation cycles that is needed to cover this distance is determined by the control element 110 by using the stitch length. The control element 110 also reads the hem projection length count from the RAM memory 117 and, depending on the stitch formation frequency, a correction value stored there, and computes the correction value by halving the hem projection length count to obtain the count associated with the rear hem projection length. The control element 110 then enters this correction value in the RAM memory 17. The control element 110 subsequently determines a residual seam count associated with the residual seam length by forming the difference of the fabric end count associated with the fabric end length and the halved hem projection length count, with which the correction value is taken into account.

Beginning from the count entered on release of the sensor 41, which will hereinafter be called the first value, the control element 110 receives the respective last count of the counting device 112 during each subsequent stitch formation cycle, and forms the difference from this and the first value. As soon as this difference reaches the residual seam count, the control element 110 stops receiving further counts at the input E2, and sends a signal to the output device 118 from the output A6. The output device 118 then sends a signal from the output OA 6 to the striker magnet of the E valve 121 for withdrawing the piston rods 23 into the cylinder 22 and consequently for switching off the needle bars 21 via the switching device 20. The time lag which develops between the sending of the signal from the output A6 of the control element 110 and the switching off of the needle bars 21 and during which a number of stitch formation cycles, whose number depends on the stitch formation frequency, are performed, is taken into account when the residual seam count is determined such that this residual seam count decreases with increasing stitch formation frequency due to the inclusion of the correction value. As a result, the signal for switching off the needle bars 21 is sent at a greater distance from the rear edge of the fabric being sewn if the stitch formation frequency increases.

After the needle bars 21 have been switched off, the feed of the fabric being sewn is continued, and the seamless rear fabric edge following the last stitch of the seam formed passes through the stitch formation site 60.

When the rear edge of the fabric releases the hem projection length sensor 43, the sensor becomes conductive by receiving the light beams arriving from the photodiode 40, as a result of which a signal is present at the input IE 5 of the input device 106. This signal causes signals to be sent to the outputs A3 and A7 of the control element 110. The drive 53 of the cutting device 50 is again activated for a cutting process by the signal at the output A3, so that the rear hem projection length will be cut through at a distance from the rear edge of the fabric corresponding to the width of the seamless rear fabric edge. As a result, the rear hem projection length can also be pushed over its entire length into the associated part of the hem.

The signal at the output A7 of the control element 110 causes a signal for stopping to be sent to the control part 123 of the positioning motor 124. The positioning motor 124 comes to a stop in a rotation position of the main shaft 6 in which the opening 9 in the pulse disk 7 is located in the path of light between the photodiode 10 and the photodetector 12 and which rotation position is associated with the top reversal position of the needle bars 21.

With a slight delay from the signals at the outputs A3 and A7, the control element 110 sends signals to the outputs A5 and A6. The signal at the output A5 causes the cylinder 26 to withdraw its the piston rod 27 and thus to lift off the presser foot 30 from the fabric being sewn, while the signal at the output A6 causes pressure to be released in the cylinder 22. The piston rods 23 of the cylinder 22 will then extend and switch on the needle bars 21 for the next sewing process via the switching device 20.

The fabric can then be removed.

While a specific embodiment of the invention has been shown and described in detail to illustrate the application of the principles of the invention, it will be understood that the invention may be embodied otherwise without departing from such principles.

What is claimed is:

1. A sewing machine for sewing a hem to a fabric part to provide a front hem projection length and a rear hem projection length and to provide a seamless front edge and a seamless rear edge, comprising: a cutting device; a microprocessor a first hem projection length sensor for generating a signal to be input to said microprocessor to initiate a cutting process for said front hem projection length; a second hem projection length sensor for generating a signal to be input to said microprocessor to initiate a cutting process for said rear hem projection length; an adjusting device for adjusting the position of said first hem projection length sensor and said second hem projection length sensor including a stop connected to drive means for movement of said stop in a direction of feed for positioning a front edge of said fabric to define a width of a seamless front edge of the fabric being sewn, said width of said seamless front edge corresponding to a distance from said stop to a stitch formation site of the sewing machine, a forward sensor, located in front of said stitch formation site at a distance from said stitch formation site corresponding to a predeterminable fabric end length, for indicating absence of the fabric, the occurrence of which corresponding to an actual fabric end length dropping below the predeterminable fabric end length, a measuring device activated by said forward sensor for measuring feed distance of the fabric, and adjusting device control means for determining a residual seam length based on a difference between said predeterminable fabric end length and said width of said seamless front fabric edge, to form a seamless rear edge, and for stopping a needle bar of the sewing machine in a top reversal position when said residual seam length is reached based on a distance measured by said measuring device.

2. A sewing machine according to claim 1, wherein said signal sent by said first hem projection length sensor initiates a measuring process for determining a width of said seamless front fabric edge, said measuring process being concluded by a signal sent by said second hem projection length sensor.

3. A sewing machine according to claim 1, wherein said measuring device includes a counting device for counting stitch formation cycles performed during said measuring process, a feed distance passed over by said fabric being sewn corresponding to a product of a count value of said counting device and a stitch length, said stitch length being preselectable on a stitch length mechanism.

4. A sewing machine according to claim 1, further comprising a memory, said memory being addressable as a function of sewing condition for providing a correction value corresponding to an actual sewing condition, said adjusting device control means using said actual sewing condition in determining said residual seam length.

5. A sewing machine according to claim 1, wherein said hem projection length sensors are moved by a drive mechanism that can be controlled in terms of direction and amount of action as a function of a preset position of said stop, while maintaining a constant distance ratio from said cutting device, in relation to said cutting device.

6. A sewing machine according to claim 5, wherein said cutting device is arranged centrally between said first hem projection length sensor and said second hem projection length sensor, said first hem projection length sensor and said second hem projection length sensor being moved by said drive mechanism by equal distances in opposite directions.

* * * * *